United States Patent [19]

Michael

[11] 4,376,361

[45] Mar. 15, 1983

[54] PARTITION WALL CONSTRUCTION

[75] Inventor: Ralph E. Michael, Elk Grove, Ill.

[73] Assignee: United States Gypsum Company, Chicago, Ill.

[21] Appl. No.: 137,666

[22] Filed: Apr. 7, 1980

[51] Int. Cl.[3] ..... E04B 2/56

[52] U.S. Cl. ..... 52/241; 52/346; 52/713; 52/403

[58] Field of Search ..... 52/238–241, 52/242, 346, 347, 357–363, 713, 714, 403, 397

[56] References Cited

U.S. PATENT DOCUMENTS

| | | | |
|---|---|---|---|
| 780,332 | 1/1905 | Forshee | 52/346 |
| 1,057,431 | 4/1913 | Jackson | 52/714 |
| 1,732,348 | 10/1929 | Balduf | 52/346 |
| 1,887,663 | 11/1932 | Reed | 52/35 |
| 2,269,384 | 1/1942 | Spinosa | 52/241 |
| 2,338,870 | 1/1944 | Praeger | 52/347 |
| 2,796,158 | 6/1957 | Miles et al. | 52/241 |
| 3,144,733 | 8/1964 | Balinski | 52/714 |
| 3,256,668 | 6/1966 | Downes | 52/238 |
| 3,394,507 | 7/1968 | Doke | 52/363 |
| 3,434,258 | 3/1969 | Leurent | 52/397 |
| 3,646,714 | 3/1972 | Groat | 52/241 |
| 3,670,466 | 6/1972 | Lynch | 52/403 |
| 3,702,047 | 11/1972 | Harcuba | 52/241 |
| 3,712,011 | 1/1973 | Husler | 52/241 |
| 3,807,112 | 4/1974 | Perina | 52/241 |
| 4,068,440 | 1/1978 | Lillethorup | 52/547 |
| 4,151,691 | 5/1979 | Wendt | 52/738 |
| 4,222,211 | 9/1980 | Pearson | 52/241 |

OTHER PUBLICATIONS

Re. 19431, reissue of U.S. Pat. 1,732,348, the reissue being dated Jan. 22, 1935.

*Primary Examiner*—James L. Ridgill

*Attorney, Agent, or Firm*—Jerome J. Adams; Robert H. Robinson; Samuel Kurlandsky

[57] ABSTRACT

An improvement in a partition wall construction having two spaced apart rows of wall board connected to flanged studs wherein studs are supportably engaged within opposingly spaced apart channels, a bottom channel opening upwardly with bottom portions of the studs residing therein and an upper channel opening downwardly with top portions of the studs residing therein. The improvement comprises a device for prevention of squeaking at stud and runner engagements when said partition well is subjected to racking forces. Said device comprising a plurality of clips each having in cross-section a hairpin-like configuration wherein an elongate plate portion terminates in a thickened base portion, said base portion having an angled plate portion including a first leg angling back toward the elongate plate, and then terminating in an outwardly angling second leg portion, said configuration forming a hairpin-like shape defining a slot between the elongate plate and angled plate portion. Stud flanges nested in said slots and contacting the thickened base portion, wherein said elongate plate is disposed between flanges of the channels and flanges of the studs. Said clips comprising acrylonitrile-butadiene-styrene and wherein said clip devices prevent squeaking and clicking upon subjection of said partition wall construction to horizontal racking forces tending to force the partition wall construction into a generally parallelogram-shape.

15 Claims, 8 Drawing Figures

PARTITION WALL CONSTRUCTION

BACKGROUND OF THE INVENTION (1) Field of the Invention

The invention relates to a partion wall construction having an improvement therein comprising a device for prevention of squeaking at stud and runner engagement when said partition wall is subjected to racking forces.

(2) Description of the Prior Art

In high rise construction, significant wind loading can cause many design problems. When wind speeds reach and exceed about 35 mph (56 kph) wind deflection occurs. The horizontal wind sheers tend to move a floor horizontally past the floor below. With the wide use of partition wall construction utilizing metal studs and metal channels, a phenomenon occurs due to such wind deflection. When the building is sustaining these increased wind loads, a partition wall may emit squeaks, creaks or clicking noises. The phenomenon appears most prevalent in the middle third of such high rise buildings and particularly in those walls parallel to the wind direction. This problem has manifested itself in both steel and reinforced concrete frame structures. It has been learned that the source of the noise is at the stud and runner intersections. The sound emitted tends to be cyclic in nature following in response to racking forces imparted to the partition by building drift and twist under moderate to high wind velocities.

If a building sways with a single bend, i.e. less than one mode, the accumulated floor-to-floor horizontal displacement accounts for the total drift at the top of the building. A drift of one foot (0.3 m) at the top of a 100 story building would result in an average $\frac{1}{8}''$ (0.3 mm) floor-to-floor horizontal displacement. The calculated drift of a high rise structure is based on wind velocity supplied by local building codes and may be grossly underestimated based upon wind tunnel research. The magnitude of true racking, i.e. translation of a rectangular building bent into a parallelogram, is not directly related to horizontal floor-to-floor displacement. Some of the displacement is accounted for by bent rotation as a result of column elongation and compression. Additionally, it is not at all unnatural for a tall slender building to have several bending modes and nodal points, thereby reducing the total drift in one direction. However, there may yet be sufficient racking between floor and ceiling runners to cause rotation or sliding of the studs within the runners. The problem of creep in flat slab construction can also contribute to the squeak problem. Deflection of the ceiling slab forces the top ends of the center studs to seat into the ceiling runner and the bottom ends of the end studs to seat into the bottom runner. This tends to inhibit partition rotation within the frame inducing more of a sliding motion between the studs and runners during building deformation. Attachment of conventional wall board to studs prevents stud rotations within the partition further inhibiting rotation and encouraging sliding. The net result is the strong potential for scraping between the ends of the studs and the web of upper and lower runners.

Until two to three decades ago, most large high rise structures were constructed so massively, using masonry walls, that wind pressure was seldom critical. That design has changed drastically within the last fifteen years and new techniques of construction for tall slender buildings utilize non-structural curtain walls. Also, the wide use of partition wall construction utilizing spaced-apart rows of wall board, which are non-load bearing, has resulted in the recited phenomenon. With the ever increasing cost of building construction, it is unlikely that the new building techniques for the structural portion of buildings will be altered and thus the solution to the problem lies in the design of partition walls for use in such constructions.

(3) Objects of the Invention

It is accordingly a primary goal of the invention to solve the problem of squeaking and clicking emitted from partition wall construction as experienced in high rise construction.

It is a further goal of the invention to solve the problem in an economic manner without drastic alteration of partition wall elements and with minimal added cost.

It is also an important goal of the invention to provide an improved partition wall construction which may be successfully subjected to thousands of racking cycles as would be normally experienced for a high rise building during its life-time.

SUMMARY OF THE INVENTION

All the aims, objects and goals of the invention are satisfied by the provision of an improved partition wall construction having two spaced-apart rows of wall board connected to flanged studs wherein said studs are supportably engaged within opposingly spaced apart channels, a bottom channel opening upwardly with bottom portions of the studs residing therein, and an upper channel opening downwardly with top portions of the studs residing therein. The improvement comprises a device for prevention of squeaking at stud and runner engagements when said partition wall is subjected to racking forces. Said device comprises a plurality of clips each having in cross-section a hairpin-like configuration wherein an elongate plate portion terminates in a thickened base portion, said base portion having an angled plate portion including a first leg portion angling back toward the elongate plate and thence terminating in an outwardly angling second leg portion, said configuration forming a hairpin-like shape defining a slot between the elongate plate and angled plate portion. Stud flanges reside in said slots and contact the thickened base portion wherein said elongate plate is disposed between flanges of the channels and flanges of the studs. The clips of said device comprise acrylonitrile-butadiene-styrene. The clip devices prevent squeaking and clicking upon subjection of said partition wall construction to horizontal racking forces tending to force the partition wall construction into a generally parallelogram-shape.

DESCRIPTION OF THE PREFERRED EMBODIMENTS

Figure 1:
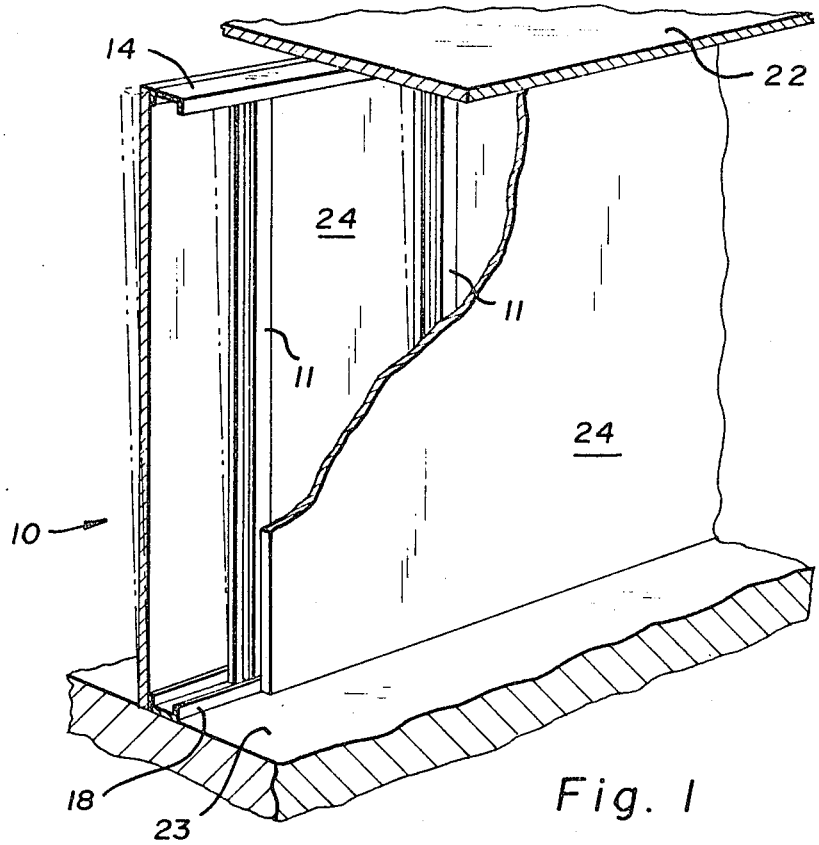
FIG. 1 is a perspective view of a typical partion wall construction, partially broken away, and showing, in phantom line, an effect of racking causing horizontal displacement of stud and runner members.

With reference first taken to FIG. 1, a conventional partition wall construction 10 is shown with phantom lines indicating displacement caused by racking forces. On center-to-center spacings of about 24" (610 mm), studs 11 are vertically placed. Studs 11 are of a channel-shape widely used in the industry. Upper ends of studs 11 are engaged within upper channels 14 and lower ends of studs 11 are engaged within lower channels 18. Upper and lower support is afforded by a ceiling structure 22 and lower support by floor 23. Spaced apart rows of wall board 24 are affixed to studs 11 in a conventional manner by the use of drywall screws. As racking forces are imparted to partition walls, and particularly those parallel to the direction of wind loading, floor 23 and ceiling 22 tend to move and thus displace partition wall construction 10 as indicated by phantom lines. While FIG. 1 illustrates the upper channel 14 being displaced to the left in the Figure, it would be apparent that both upper channel 14 and lower channel 18 may be displaced in opposite directions, or with one of the channels moving relative to the other one being maintained in a stationary position. When such displacement occurs, the generally rectangular configuration of partition wall construction 10 is forced into a parallelogram-shape due to this horizontal movement of upper channels 14 and lower channels 18. Upon such occurrence, squeaking and clicking has been detected, and most pronouncedly so in high rise construction for buildings greater than about 10 to 15 floors.

Figure 2:
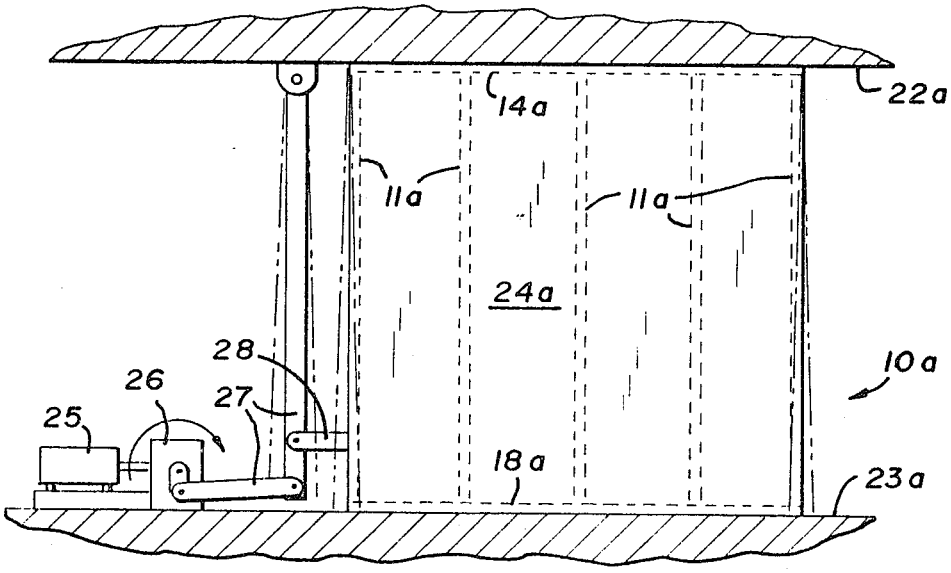
FIG. 2 is an elevational view of a partition wall construction subjected to testing procedures simulating racking forces therein.

In order to investigate and solve such noise emission problems, a test partition wall construction **10*a* was constructed for such a study and is illustrated in FIG. 2. Partition wall construction 10*a* is shown having upper channel 14*a* and lower channel 18*a* with studs 11*a* disposed vertically therebetween at a center-to-center spacing of about 24" (610 mm) in a typical manner. It is clear that studs 11*a* may be spaced at other conventional spacings such as 16" (406 mm) or 30" (762 mm). Wall board 24*a*, which has been removed for illustrative purposes at the front side of partition wall construction 10*a*, was affixed to studs 11*a* by conventional dry wall screw means. An upper support being ceiling structure 22*a* was connected by upper channel 14*a* while lower channel 18*a* was affixed to floor structure 23*a*. To allow racking tests to take place and afford investigation, studs 11*a* were not affixed by screws, or the like, to channels 14*a* and 18*a*. The initial steps in attempting to produce squeaks in a laboratory situation were conducted in a quiet environment with electronic analysis equipment available for detection of cyclic squeaking and clicking noise emissions. The sliding motion was exaggerrated beyond what would normally be experienced in a typical construction and floor channel 18*a* was allowed to displace ⅛" to ¼" (3–6 mm). Such exaggerated movement allowed study of the phenomenon at the discretion of the observer. The procedure readily produced squeaks in the partitions and the movement of partition wall construction 10*a* produced sounds identical to those sounds recorded during field evaluations. The similar acoustical characteristics of the tested partition wall confirmed the noise emissions noticed in the field. The testing procedure for partition wall construction 10*a* was firstly run with 4" (102 mm) wide, 25 gauge (0.5 mm) electrogalvanized dry wall steel studs 11*a* and channels 14*a* and 18*a*. Wall board 24*a*, comprising conventional gypsum dry wall material, was provided in a ½" (12.7 mm) thickness and was applied to studs 11*a* with screws spaced 12" (305 mm) center-to-center. A similar second test was performed utilizing the same size studs 11*a* and channels 14*a* and 18*a*** but the material was hot dipped galvanized steel.

Inducement of simulated racking forces was attained by utilizing an electric motor 25 and gear reducer 26 which provided 60 rpm. Linkage 27 was provided to cooperate from gear reducer 26 thereby driving arm 28 horizontally from about ⅛" to about ¼" (3–6 mm). Numerous series of testing cycles were conducted with the intention of utilizing various materials and artifices including changing stud and channel materials and shapes, as well as wall board thicknesses, in order to alleviate noise emission. Various design alterations and modifications failed to stop the squeaking and clicking noise emissions. Channels **14*a* and 18*a* were provided in aluminum and again in stainless steel without success. Additional tests included conventional electro galvanized steel, or hot dipped galvanized steel, channels and studs. With these runner materials runner coatings were applied such as polyethylene industrial floor marking tape, urethane elastomer (brush applied), silica carbide epoxy, polyolefin epoxy. The thicknesses were from about 0.010" up to about 0.034" (0.254–0.864 mm) for the brush applied elastomers and epoxy compounds. A urethane primer and an enamel top coat were similarly investigated utilizing a spray application on the channels in a thickness of about 0.003" to about 0.006" (0.076–0.152 mm). Channels 14*a* and 18*a* were coated in another manner utilizing a fluidized bed application of nylon in a thickness of about 0.010" (0.254 mm). Additional roller applied coatings were attempted for both studs 11*a* and channels 14*a* and 18*a*. These coatings involved: plastisol over a steel substrate; polyester over a steel substrate; and, fluorocarbon over an aluminum substrate. In all the foregoing, it was noticed that the engagements between studs and channels were the source of the noise emission and that utilizing these various materials or coatings did not successfully prevent noise emissions for more than a few thousand cycles in even the most successful of the tests. Lubricants were investigated such as S.A.E. 20W motor oil and M-6 density LUBRIK grease. Again, after only a thousand cycles, the noise emission was evident. Attempts were made to separate studs 11*a* from channels 14*a* and 18*a* and thus alleviate the metal to metal contact which was the source of the noise emission. Variously formed inserts and clips were fitted around stud flanges to separate studs 11*a* from flanges of channels 14*a* and 18*a***. Some materials utilized were GEON Vinyl, nylon, cast DELRIN (fluorocarbon plastic), polyvinyl chloride. Modest success was obtained with the use of a cast DELRIN clip material which successfully ran for over 300,000 test cycles without producing squeaks. The material, formed in a particular configuration, which was discovered in the course of this testing and successfully reduced squeaking for extended test cycles, was acrylonitrile-butadiene-styrene (ABS). Both extruded and cast ABS clip devices were investigated. An extruded ABS clip was found to be the answer to the problem after this investigation regardless of the metal used for runners and channels, or wall board thickness provided.

ABS is a generic term for a group of tough, rigid thermoplastics. Most contemporary ABS resins are true graft polymers consisting of an elastomeric polybutadiene or rubber phase, grafted with styrene and acrylonitrile monomers for compatibility, dispersed in a rigid styrene acrylonitrile (SAN) matrix. Mechanical polyblends of elastomeric and rigid co-polymers, e.g. butadiene-acrylonitrile rubber and SAN, historically the first ABS resins, are also alternatives. ABS has dimensional stability over a temperature range of from −40° F. to +160° F. This material is processed by conventional molding or extrusion methods. Other properties include specific gravity 1.04; tensile strength about 6500 psi; flexural strength 10,000 psi; good electrical resistance; and, water absorbtion 0.3–0.4%. Wide uses have been made of ABS resin, but none have been utilized for the solution to the problem herein. Some applications are in automobile body parts and fittings; telephones; bottles; heels; luggage; packaging; refrigerator door liners; plastic pipe; building panels; shower stalls; boats; radiator grills; machinery housings; and, business machines.

Figure 3:
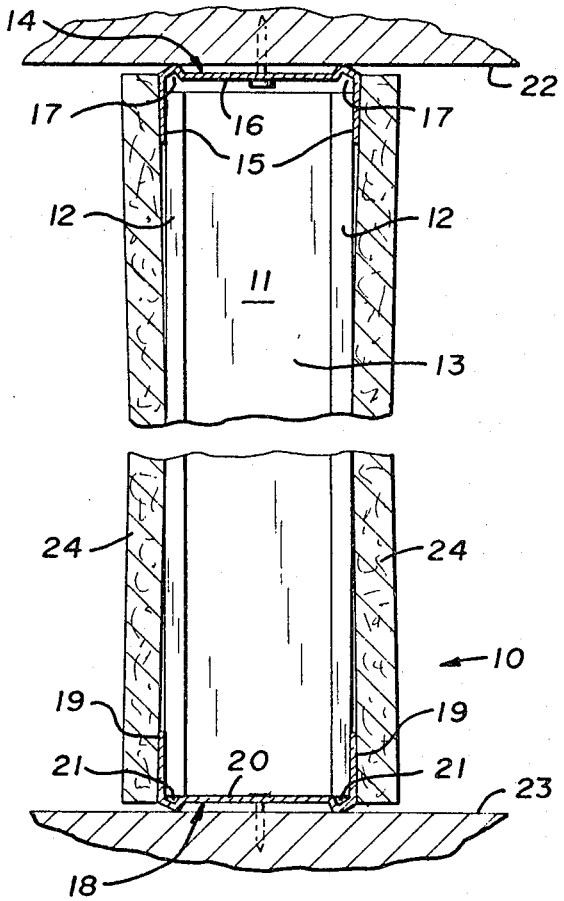
FIG. 3 is a cross-sectional view of a typical partition wall construction showing the engagement between studs and runners with wall board attached at opposite sides in spaced-apart relationship.

Turning now to FIG. 3, a cross-section of partition wall construction 10 is shown. The result of testing procedures indicated that flanges 12 of studs 11 in a conventional partition wall construction 10 stick and slip with respect to flanges 15 of upper channels 14 and flanges 19 of lower channels 18. Additionally, the bases 16 of upper channels 14 and bases 20 of lower channels 18 can come into contact with ends of webs 13 of studs 11 providing an additional area of metal to metal contact. The stick and slip phenomenon caused by racking forces was observed at these contact portions. As shown in FIG. 3, conventional channel-shapes for upper channels 14 and lower channel 18 are shown wherein flanges 15 and 19 respectively meet bases 16 and 20 at troughs 17 and 21, respectively. This conventional channel design is utilized for strength and rigidity and is well known to the industry. Thus, in an attempt to solve the noise emission problem, a device was sought to be developed that would have industry wide application without significant alteration of existing elements. In these configurations for upper channels 14 and lower channel 18, it is seen that base 16 of upper channel 14 is slightly depressed below ceiling 22 and base 20 slightly raised above floor 23. In the testing of partition wall 10*a* shown in FIG. 2, additional tests were run providing a damping compound on these exteriors, or hollow sides, of bases 16*a* and bases 20*a* in an attempt to dampen cyclic emissions. Such was not successful after about 3,000 to 4,000 test cycles.

Figure 4:
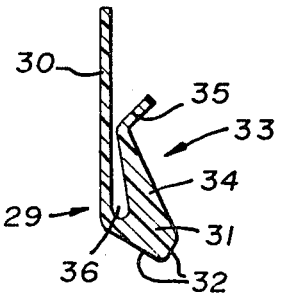
FIG. 4 is a cross-sectional view of the clip device in accordance with this invention for prevention of squeaking and clicking in partition wall construction.
Figure 5:
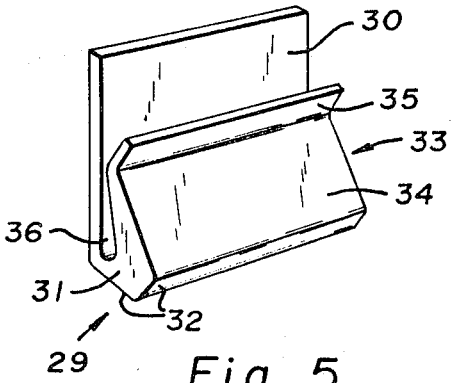
FIG. 5 is a perspective view of the preferred embodiment of the clip device in accordance with this invention as shown in FIG. 4.

With reference now taken to FIGS. 4 and 5, the discovery made by the inventor is shown in the preferred embodiment utilizing extruded ABS. To a lesser extent but still successful, a cast ABS clip having substantially the same configuration as clip device 29 would be suitable. Clip 29 is provided in a hairpin-like shape wherein elongate plate portion 30 terminates at a lower portion in thickened base portion 31. Thickened base portion 31 preferably has bottom 32 in a wedge-shape for nesting engagement within troughs 17 and 21 of channels 14 and 18. Thickened base portion 31 extends upward in an integral angled plate portion 33 having a first leg 34 angling back toward elongate plate portion 30 and thence angling outwardly in a second leg 35. Between angled plate portion 33 and elongate plate portion 30 a flange engageable slot 36 is thereby defined. With the provision of angled plate portion 33, a retentive characteristic is incorporated in clip 29 thereby allowing an installer to attach clip devices 29 to studs 11 before placement within upper channels 14 and lower channels 18. Thus a stud 11 can be readily handled without clips 29 falling off to thereby ease installation. The length of clip 29 is desirably provided in the same dimension as the extension of flanges 12 from webs 13 of studs 11 to accordingly fully nest flanges 12 within slots 36 and thus separate flanges 12 from channels 14 and 18. Similarly, the overall height of elongate plate portion 30 is provided in a dimension which corresponds to the extension of flanges 15 from base 16 of upper channel 14, and similarly, corresponds to the extention of flanges 19 from base 20 of lower channels 18, thereby providing full separation between flanges 12 of studs 11 and channels 14 and 18. The thickness of elongate plate portion 30 is preferably of a minimum thickness of about 0.015" (0.4 mm). With utilization of clip device 29, it is preferable that upper channels 14 and lower channels 18 be slightly wider than a conventional 2½" (64 mm) dimension to accommodate this inserted element. Thus the preferable embodiment envisions utilizing channels having widths of about 2 9/16" (66 mm) for accommodation of clip devices 29. Testing has shown that with this preferred conformation, squeaking can be eliminated for up to about 800,000 test cycles in a partition wall.

Figure 6:
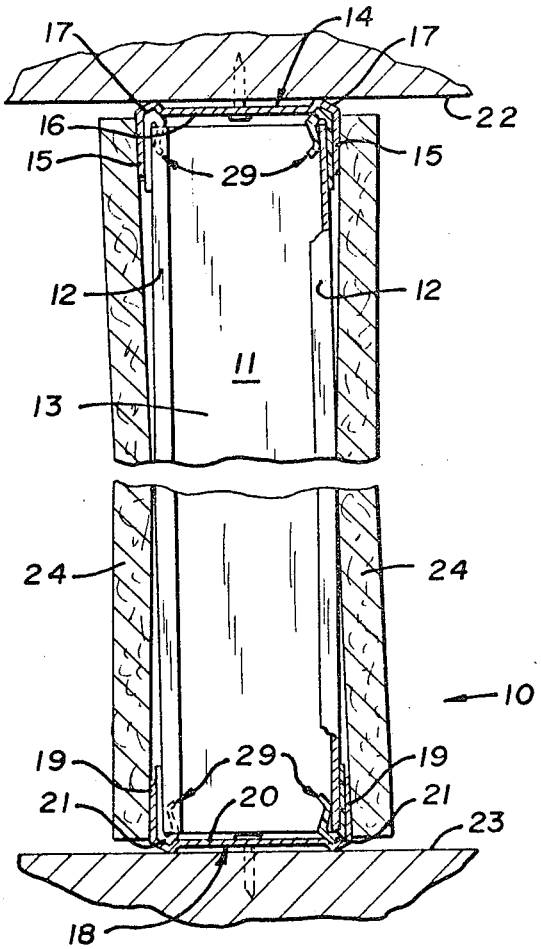
FIG. 6 is a cross-sectional view of the improved partition wall construction in accordance with this invention utilizing the clip device for the prevention of squeaking and clicking.

Turning now to FIG. 6, the installation of clip devices 29 is shown wherein at each stud 11 of partition wall construction 10, four clip devices 29 are installed, two at each opposite end of studs 11. Clips 29 nest flanges 12 within slots 36 for separation of studs 11 from upper channel 14 and lower channel 18, as shown. With the conventional design of channels 14 and 18, bottom 32, having a wedge-shape, nests within trough 17 and trough 21. In FIG. 6, it is seen that flanges 12 terminate in inwardly rebent portions in a conventional manner, and thus the length of clip devices 29 is provided in a corresponding dimension for the full coverage of the extension of flanges 12 from web 13 between the rebent portion and web 13.

Figure 7:
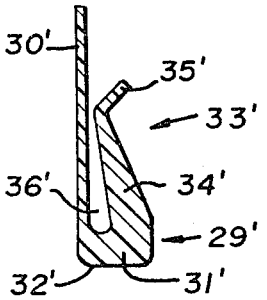
FIG. 7 is a cross-sectional view of an alternate preferred embodiment for the clip device in accordance with this invention.
Figure 8:
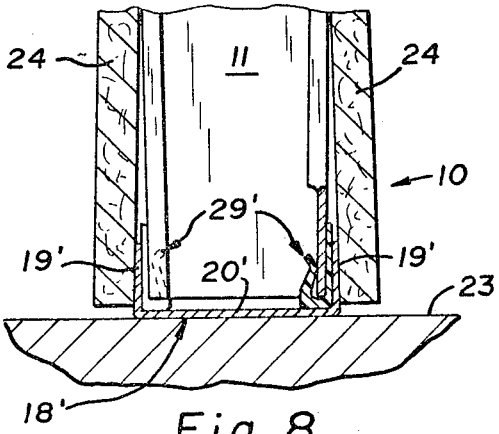
FIG. 8 is a cross-sectional view of an improved partition wall in accordance with this invention utilizing the alternate configuration for the clip device consonant with the invention.

With reference taken now to FIGS. 7 and 8, an alternate preferred embodiment for this invention is shown for use with other channel shapes. It is seen in FIG. 7 that a clip device 29' is provided with an elongate base 30' terminating in a thickened base portion 31'. Thickened base portion 31' has bottom 32' which has a flat shape. Thickened base portion 31' extends upwardly to terminate in an integral angled plate portion 33' having a first leg 34' angling back toward elongate plate portion 30' and thence outwardly in a second leg 35'. A slot 36' is defined therebetween for accommodation of flanges 12 of studs 11. As illustrated in FIG. 8, one alternate channel shape is shown and is illustrated as lower channel 18'. Channel 18' has a base 20' which meets flanges 19' in a right angle intersection rather than a trough. Thus, bottom 32 is compatible for usage with this alternate channel-shape. In all other respects, clip device 29' is substantially identical to clip device 29 and affords the same installation ease and successful reduction of squeaking and clicking noises in a partition wall construction 10. Although apparent but not shown, an opposingly faced upper channel, having substantially the same shape as lower channel 18' would be accommodated thereabove.

It is thus seen that the invention provides successful alleviation of noise emissions in partition wall construction caused by metal to metal contact between studs and channels, when subjected to racking forces generally caused by wind loading in a high rise building. While limited success was obtained with a variety of clip materials and stud and channel alterations, it has been discovered that the particularly disclosed shapes for clip 29 and 29' are the most successful for use in conventional partition wall construction. While it is preferable to use extruded acrylonitrile-butadiene-styrene for this invention, a cast acrylonitrile-butadiene-styrene may be successfully substituted. Testing has shown that a cast ABS clip device will prevent noise emission for about 300,000 test cycles prior to failure. Also, as previously noted, a cast fluorocarbon plastic (DELRIN) was successfully tested. It attained results comparable to a cast ABS clip device. However, such plastics are expensive and would not satisfy an important object of the invention, namely, to reduce noise emissions from cyclic rocking while minimizing any added cost. The inclusion of this improvement in partition wall construction does not significantly increase installation time or cost of materials. Thus this critical object of the invention, to provide a solution to the problem without unduly increasing cost, has been obtained. While channels desirably are provided in a slight increase in width of about 1/16" (2 mm), such can be easily manufactured. With the slight thickness of the clip device of this invention, conventional channel sizes can be used if the wider channel cannot be obtained. A tighter fit would be experienced but would not severely impair the installation.

While the preferred embodiment for the utilization of a clip device having a particular shape has been shown, it is to be understood that all equivalent modifications and shapes that would be feasible within the scope of this disclosure are intended to be well within the broad range of the invention. Thus, equally suitable alternate embodiments are envisioned herein as would be well understood by one skilled in the construction arts.

What is claimed is:

1. In a partition wall construction having two spaced apart rows of wall board connected to flanged studs wherein said studs are supportably engaged within opposingly spaced apart channels, a bottom channel opening upwardly with bottom portions of the studs residing therein and an upper channel opening downwardly with top portions of the studs residing therein, the improvement comprising:

a device for prevention of squeaking at stud and runner engagements when said partition wall is subjected to racking forces, said device comprising a plurality of clips each having in cross-section a hairpin-like configuration wherein an elongate plate portion terminates in a thickened base portion, said base portion having an angled plate portion including a first leg portion angling back toward the elongate plate and thence terminating in an outwardly angling second leg portion, said configuration forming a hairpin-like shape defining a slot between the elongate plate and angled plate portion;

stud flanges nested in said slots and contacting the thickened base portion, wherein said elongate plate is disposed between flanges of the channels and flanges of the studs;

said clips comprising acrylonitrile-butadiene-styrene; and wherein said device prevents squeaking and clicking upon subjection of said partition wall construction to horizontal racking forces tending to force the partition wall construction into a generally parallelogram-shape.

2. An improved partition wall construction as claimed in claim 1 wherein the lower channels and upper channels each have base portions interconnecting flange portions at opposite ends thereof.

3. An improved partition wall construction as claimed in claim 2 wherein said upper channels and lower channels have centrally raised base portions terminating at longitudinal troughs at said flange portions, said thickened base portions of said clips residing within said longitudinal troughs.

4. An improved partition wall construction as claimed in claim 1 wherein said clip devices have a width dimension substantially the same as the stud flanges and wherein said elongate plate portions have a height dimension substantially the same as the channel flanges.

5. An improved partition wall construction as claimed in claim 4 wherein said flanged studs include web portions integrally connecting spaced-apart generally parallel flange portions.

6. A clip device for use in partition wall construction utilizing spaced-apart rows of wall board supported by stud means residing within channels of upper and lower runners for support, said clip device comprising an extruded plastic material having an elongate plate portion which terminates in a thickened base portion, said thickened base portion having at an opposite edge thereof an angled plate member forming a slot between the angled member and elongate plate portions, said clip cooperative with flanged runners having spaced apart flanges, wherein at opposite ends of stud means stud flanges may nest within slots of oppositely disposed clip devices and thereby separate upper and lower runner members from stud means.

7. A clip device as claimed in claim 6 wherein said extruded plastic clips comprise acrylonitrile-butadiene-styrene.

8. A partition wall construction which when subjected to racking forces prevents squeaking and clicking at interconnections between flanged studs and oppositely disposed channel-shaped supportive runner members, said partition wall construction including acrylonitrile-butadiene-styrene clip members affixed at opposite stud ends wherein said clip devices are of a generally hairpin-shape construction providing a slot between a plate portion and an angled portion, the juncture of said plate portion and angled portion forming a thickened base portion whereby said clip members are disposed having said plate portion residing adjacent flanges of channel-shaped runners with flanges of stud members residing within said slot to thereby separate studs from runners.

9. A partition wall construction as claimed in claim 8 wherein said clip members have a horizontal dimension substantially the same as the stud flanges and a vertical dimension substantially the same as the channel flanges.

10. A partition wall construction as claimed in claim 8 wherein said stud members include spaced-apart parallel planar flange portions extending integrally from a base member, said flanges extending from ends of said base member, wherein said clip members have a width sufficient to accommodate subtantially the entire extending dimension of said flanges within said slots.

11. A partition wall construction as claimed in claim 8 wherein said channel members comprise lower channel-shaped runners having upwardly extending flanges integrally connected at trough portions with a centrally raised base member, and upper runner members comprise downwardly extended flanges integrally connected at trough portions with a centrally depressed base member, wherein said extending flanges of both upper runners and bottom runners opposingly extend from said base members, and said plate portion of said clip separates said stud flanges from said runner flanges.

12. A partition wall construction as claimed in claim 8 wherein said stud members and runner members comprise metal.

13. A partition wall construction as claimed in claim 8 wherein said stud members and runner members comprise steel.

14. A partition wall construction as claimed in claim 8 wherein said wallboard comprises gypsum.

15. A partition wall construction as claimed in claim 8 wherein said stud members engage said top runners and bottom runners by means of self-drilling self-tapping metal screws and said gypsum wall board panels are connected to said stud members by dry wall screws.

* * * * *